US011479925B2

(12) United States Patent
Schmidt et al.

(10) Patent No.: US 11,479,925 B2
(45) Date of Patent: Oct. 25, 2022

(54) LIMITING PLATE OF A ROAD PAVER

(71) Applicant: JOSEPH VOEGELE AG, Ludwigshafen/Rhein (DE)

(72) Inventors: Thomas Schmidt, Plankstadt (DE); Martin Seibel, Bruchsal (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 0 days.

(21) Appl. No.: 16/427,996

(22) Filed: May 31, 2019

(65) Prior Publication Data

US 2019/0368136 A1 Dec. 5, 2019

(30) Foreign Application Priority Data

Jun. 1, 2018 (EP) ..... 8175547

(51) Int. Cl.
*E01C 19/18* (2006.01)
*E01C 19/48* (2006.01)

(52) U.S. Cl.
CPC ..... *E01C 19/185* (2013.01); *E01C 19/4873* (2013.01)

(58) Field of Classification Search
CPC ..... E05D 11/1028; E05D 11/105; E05D 11/1078
USPC ..... 16/233, 319, 349, 352
See application file for complete search history.

(56) References Cited

U.S. PATENT DOCUMENTS 15,390 A * 7/1856 Rodefer ..... E04G 3/26 182/45
24,062 A * 5/1859 Stetson ..... A01D 34/02 56/264
25,201 A * 8/1859 Hussey ..... A01D 34/02 56/268
55,921 A * 6/1866 Smith ..... A01B 35/08 172/323
62,971 A * 3/1867 Repp ..... A01B 35/08 172/654
RE2,783 E * 10/1867 Stealey ..... 56/3
71,164 A * 11/1867 Harner ..... A01D 57/00 56/164

(Continued)

FOREIGN PATENT DOCUMENTS

CN 200955117 Y 10/2007
CN 201473858 U 5/2010

(Continued)

OTHER PUBLICATIONS

Japanese Office Action dated Aug. 18, 2020 (with English Machine Translation), Application No. 2019-100339, 19 Pages.

(Continued)

*Primary Examiner* — Raymond W Addie
(74) *Attorney, Agent, or Firm* — Brooks Kushman P.C.

(57) ABSTRACT

A limiting plate of a road paver is detachably attached to a traverse or to a chassis of the road paver to increase the basic working width. The limiting plate is arranged with variable spacing to a subgrade. In order to prevent a mix from flowing forwards in a direction of travel and at the same time improve the efficiency of a screw conveyor, in which a geometrically defined screw trough is formed, a limiting plate extension is arranged on the limiting plate so that it can be adjusted, particularly in the direction of the subgrade.

28 Claims, 6 Drawing Sheets

(56) References Cited

U.S. PATENT DOCUMENTS 649,387 A * 5/1900 Wright ..... E05D 11/1007 16/344
1,295,680 A * 2/1919 Benson ..... A47B 27/02 108/4
1,433,069 A * 10/1922 Clarke ..... B66F 1/06 254/114
2,184,913 A * 12/1939 Fuller ..... E01C 19/187 404/96
2,837,203 A * 6/1958 Reeser ..... B65G 19/28 198/860.5
3,109,351 A * 11/1963 Dunn ..... E01C 19/15 404/104
3,262,378 A * 7/1966 Schrimper ..... E01C 19/4853 404/120
3,373,669 A * 3/1968 Schmitz ..... E01C 19/4873 404/110
3,403,609 A 10/1968 Bradshaw et al.
3,464,131 A * 9/1969 McCabe ..... D06C 3/00 38/143
3,512,461 A * 5/1970 Green ..... E01C 19/15 404/120
3,517,929 A * 6/1970 Sampson, Jr. ..... A63B 5/10 482/54
3,526,173 A * 9/1970 Brandstetter ..... E01C 19/4873 404/108
3,550,691 A * 12/1970 Peterson ..... E02F 9/2875 172/699
3,583,014 A * 6/1971 Brown et al. ..... B65G 69/2841 14/71.3
3,897,097 A * 7/1975 Davis, Jr. ..... B66C 1/24 294/81.5
3,901,616 A * 8/1975 Greening ..... E01C 19/4873 404/102
3,907,451 A * 9/1975 Fisher ..... E01C 19/4873 404/101
4,073,592 A * 2/1978 Godberson ..... E01C 19/407 404/105
4,289,421 A * 9/1981 Sampey ..... E01C 19/405 404/106
4,312,602 A * 1/1982 Dale ..... E01C 23/04 404/100
4,492,490 A * 1/1985 Christine ..... E01C 23/06 296/183.2
4,966,517 A * 10/1990 Tune ..... B66F 7/22 212/180
5,232,305 A * 8/1993 Bassett ..... E01C 19/48 404/101
6,398,453 B1 * 6/2002 Stegemoeller ..... E01C 19/185 222/527
6,543,962 B2 * 4/2003 Wells ..... E01C 19/42 404/118
7,011,123 B2 * 3/2006 Peterson ..... B27L 7/00 144/193.1
7,021,606 B2 * 4/2006 Raycraft ..... E04F 21/1811 254/329
8,057,367 B2 * 11/2011 Giannelli ..... A63B 21/0628 482/102
3,267,619 A1 9/2012 Munz
8,506,204 B1 * 8/2013 Reames ..... E01C 19/266 404/86
9,869,488 B2 * 1/2018 Glenn ..... E05D 11/1007
10,150,660 B2 * 12/2018 Koppelaar ..... E01C 19/20
2003/0039531 A1 * 2/2003 Bickle ..... B66C 23/202 414/11
2014/0064848 A1 3/2014 Engel et al.
2014/0158465 A1 * 6/2014 Salzman ..... E06C 5/22 182/127
2017/0051460 A1 2/2017 Guilmette
2018/0215595 A1 * 8/2018 Koppelaar ..... B66F 7/28
2019/0177939 A1 * 6/2019 Guggino ..... E01H 5/066
2019/0368136 A1 12/2019 Schmidt et al.
2020/0339359 A1 * 10/2020 Bergkamp ..... A01F 12/46

FOREIGN PATENT DOCUMENTS

CN 102704384 A * 10/2012
CN 102704384 A 10/2012
CN 202644359 U 1/2013
CN 103498406 A 1/2014
CN 103526671 A 1/2014
CN 103708389 A 4/2014
CN 104032656 A 9/2014
CN 104452553 A 3/2015
CN 210657898 U 6/2020
DE 10 2010 004 785 A1 5/2011
EP 1 120 495 A1 8/2001
EP 2 169 117 A1 3/2010
EP 2325393 A1 5/2011
EP 2169117 B1 7/2013
EP 3575491 A1 * 12/2019 ..... E01C 19/185
GB 1355620 A * 6/1974 ..... E01C 19/4873
GB 1382163 A * 1/1975 ..... E01C 19/4866
JP 2004011347 A 1/2004
JP 2004108042 A 4/2004
JP 4034127 B2 1/2008

OTHER PUBLICATIONS

European Search Report dated Dec. 19, 2018, Application No. 18175547.1, Applicant Joseph Voegele AG, 13 Pages.
Extended European Search Report dated Mar. 13, 2019, Application No. 18175547.1, Applicant Joseph Voegele AG, 12 Pages.
Chinese Office Action dated Dec. 31, 2020, Application No. 201910466283.1, 9 Pages.
European Intention to Grant dated Dec. 3, 2020, Application No. 18 175 547.1-1002—Applicant Joseph Voegele AG, 29 Pages.
Indian Examination Report dated Dec. 8, 2020, Application No. 201914020857, 7 Pages.
Chinese Office Action dated Aug. 12, 2021 (with English Machine Translation), Application No. 201910466283.1, 19 Pages.
European Opposition (with English Machine Translation) dated Jan. 3, 2022 Application No. / Patent No. 18175547.1-1002 / 3575491, Applicant Joseph Voegele AG. 50 Pages.
Chinese Office Action (with English Machine Translation) dated Jan. 25, 2022, Application No. 201910466283.1, Applicant Joseph Voegele & Co., 15 Pages.

* cited by examiner

LIMITING PLATE OF A ROAD PAVER

CROSS-REFERENCE TO RELATED APPLICATIONS

This application claims foreign priority benefits under 35 U.S.C. § 119(a)-(d) to European patent application number EP 18 175 547.1, filed Jun. 1, 2018, which is incorporated by reference in its entirety.

TECHNICAL FIELD

The disclosure refers to a limiting plate and limiting plate assembly of a road paver.

BACKGROUND

A road paver is used for paving bound and unbound mixes for producing paved areas, in particular roads. It is possible that a certain basic working width of the road paver can be increased by laterally mounted screw conveyors. The corresponding screw conveyors or screw extensions are mounted with limiting plates. Such limiting plates are mounted in the direction of travel in front of a corresponding screw shaft on a screw conveyor frame part or directly on the chassis of the road paver. Together with a paving screed, they form a so-called screw trough. The limiting plates require a minimum distance to the ground or subgrade to avoid collisions with it. For larger paving thicknesses, the distance between the limiting plates and the subgrade is increased by adjusting the screw or chassis height.

With such well-known limiting plates on the road paver, it is possible for mix to flow forward from a screw space below the limiting plates in the direction of travel of the road paver. There this mix can cool down and thus worsen the paving result in the corresponding production of paved areas.

SUMMARY

The disclosure is based on the object of preventing such a flow of mix forward in the direction of travel and at the same time improving the efficiency of the screw conveyor by forming a geometrically defined screw trough.

To solve the object, a novel limiting plate is proposed. This limiting plate is characterized in particular by the fact that a limiting plate extension is arranged on the limiting plate in particular adjustable in the direction of the subgrade. This prevents mix from flowing forward from the screw space under the limiting plates in the direction of travel. In addition, this limiting plate extension between the screw conveyor and the limiting plate forms a geometrically defined screw trough.

At the same time, the adjustability of the limiting plate extension ensures that material flow in the direction of travel towards the front is safely reduced during paving, but that the required ground clearance for the road paver during transport is not undercut.

In a first embodiment, the limiting plate extension is designed for example as a pivoted flap extension mounted on the limiting plate. This means that the flap extension can be pivoted in such a way that, for example, depending on the distance between the limiting plates and the subgrade, mix is prevented from flowing out of the screw space. At the same time, the required ground clearance for the road paver during transport can be set.

In the simplest case, the flap extension can essentially be pivoted at the lower end of the limiting plate. This essentially results in a uniform face of limiting plate with corresponding flap extension. It is also possible to pivot the flap extension at a distance from the lower end of the limiting plate.

In the case mentioned above, it is still advantageous if a pivot axis connects the limiting plate and the flap extension. This axis can extend along the lower end of the limiting plate.

In order to be able to arrange the flap extension accordingly in different positions, the flap extension can be connected via an adjustable joint mechanism in particular to a rear side of the limiting plate (i.e., front side of the limiting plate with respect to the direction of travel of the road paver).

Such a joint mechanism may also be electrically or hydraulically operable. In another case, the joint mechanism has a joint rod and a hinged flange protruding from the flap extension on which the joint rod is pivotally mounted. By correspondingly actuating the joint rod, the flap extension can then be arranged in different inclination positions relative to the limiting plate via the hinged flange.

For the simple arrangement of the joint rod on the limiting plate, the joint rod can be fixed to a retaining bracket projecting from a rear side of the limiting plate (i.e., front side of the limiting plate with respect to the direction of travel of the road paver) in at least one fold-in and one fold-out position. In the fold-in position, the flap extension is pivoted back, so that essentially only the limiting plate interacts with the screw conveyor. In the fold-out position, the flap extension supplements the limiting plate. Different intermediate positions between fold-in and fold-out position are also conceivable.

To easily support the joint rod on the retaining bracket, the retaining bracket may have two spaced bracket parts between which the joint rod is located. It may also be advantageous if the joint rod has a number of positioning openings by means of which different relative positions of the joint rod and retaining bracket are determined.

For different fixing, even at a distance from the rear side of the limiting plate, it may also be advantageous if the retaining bracket has at least two pairs of fixing openings spaced apart substantially perpendicularly to the rear side of the limiting plate, with which the positioning openings are aligned in the different relative positions and in which a fixing means engages. The fixing means serves to secure the various relative positions by engaging in the pair of fixing openings and the corresponding positioning openings.

In order to pivot the joint rod together with the hinged flap extension in a simple manner, the joint rod can have a handle at its upper end. In this context, it may also be beneficial if the joint rod has a lower hinged section inclined towards the hinged flange and a positioning section extending substantially vertically from that section towards the retaining bracket.

It is also conceivable that the limiting plate extension is designed as a slide extension, with a substantially vertically displaceable sliding plate and a bearing part, wherein the bearing part can be attached to the limiting plate. The sliding plate can be moved vertically relative to the bearing part and can be arranged in different positions analogous to the fold-in and fold-out positions. In the fold-out position, for example, the sliding plate is lowered downwards in the direction of the subgrade, while in the fold-in position it is shifted upwards to its maximum vertical position relative to the bearing part.

In order to be able to adjust the sliding plate in a simple manner and, for example, fasten it relative to the bearing part, the bearing part can have a sliding guide for a sliding rod connected to the sliding plate and/or guide slots for displacement projections protruding from the sliding plate. By means of the sliding guide the sliding plate is vertically adjustable via the sliding rod and by means of the guide slots the sliding plate is guided relative to the bearing part via the protruding sliding projections and can be fastened there if necessary.

In this context, it may also be advantageous if the sliding plate has an adjusting projection with a threaded section in which the sliding rod is engaged with an external threaded section for height adjustment. This means that by turning the sliding rod, the sliding plate is moved further up or down relative to the bearing part via the thread engagement.

In the simple embodiment, the displacement projections can be designed as displacement bolts and/or have a screw connection end section. For example, nuts can be screwed onto this screw connection end section in order to fix certain positions of the sliding plate relative to the bearing part.

In order to also support the sliding rod on the sliding plate, the sliding rod can be mounted longitudinally displaceably in a bore in the upper cover edge of the sliding plate. This bore allows the sliding plate to be guided vertically relative to the sliding rod when it is twisted.

It can also be advantageous for the sliding plate and a limiting plate extension in general if it is electrically or hydraulically adjustable, so that manual adjustment is not necessary. In the case of an electric or hydraulic adjustment, a remote-controlled adjustment can also be carried out. It should also be noted that the limiting plate extension may have a rubber wiper at its lower end or that a lower end section of the limiting plate extension is designed as such a rubber wiper. This means that in the event of a slight collision with the ground or subgrade, this rubber wiper can avoid damage to the limiting plate and, in particular, the possibility of adjusting the corresponding flap extension.

In the following, advantageous embodiments of the disclosure are explained in more detail with reference to the attached Figures.

DETAILED DESCRIPTION

Figure 1:
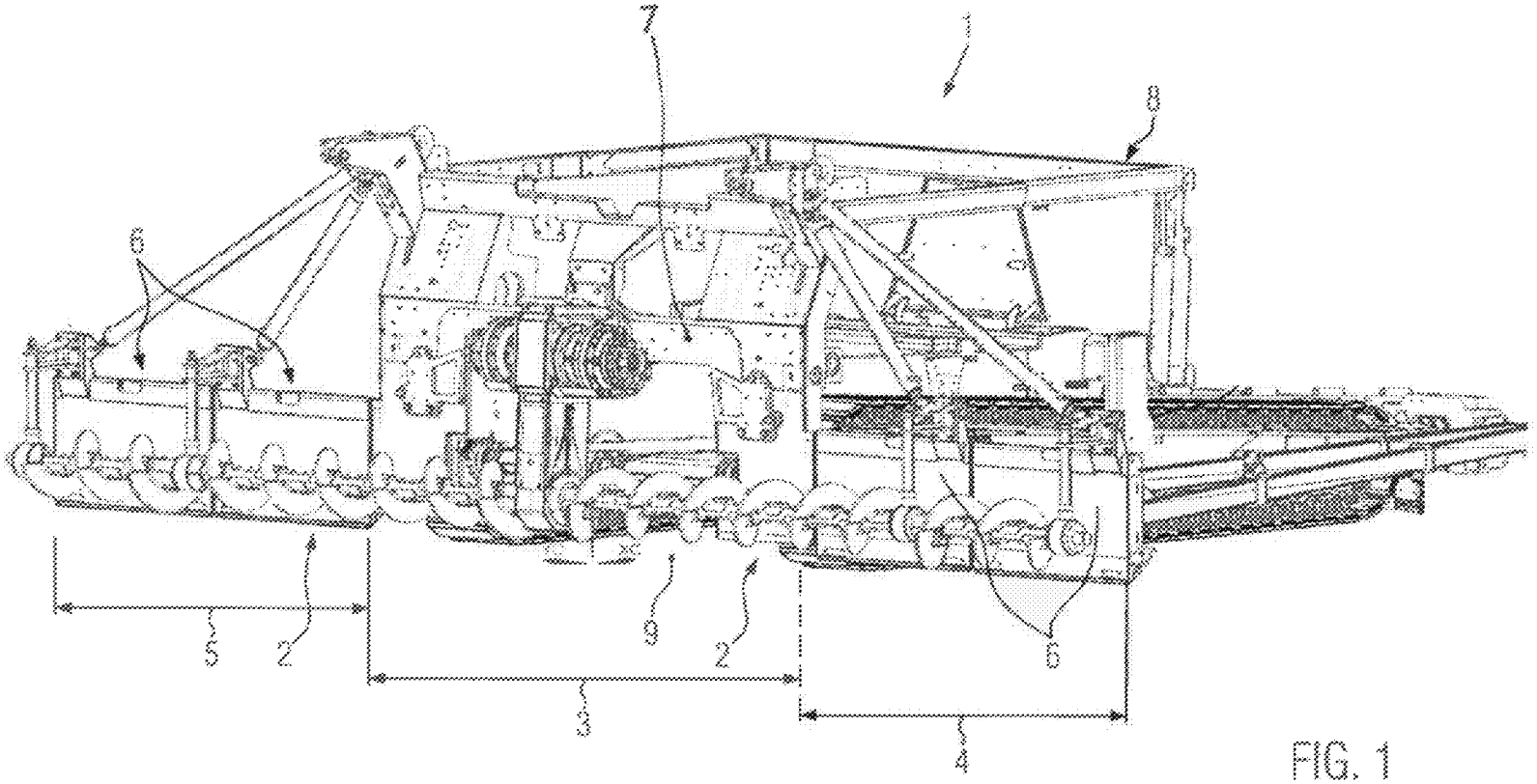
FIG. 1 shows perspective front view of a road paver (i.e., rear view with respect to a direction of travel of the road paver) with lateral screw conveyors and limiting plates according to the disclosure.

FIG. 1 shows a perspective view from an oblique rear onto a road paver 1 with two lateral screw conveyors 2 for increasing a basic working width 3 by corresponding lateral working widths 4 and 5. Such a road paver 1 is substantially known, the lateral screw conveyors 2 being assigned a number of limiting plates 6. These are arranged in the direction of travel in front of the screw conveyors 2 and are mounted on a corresponding traverse 7 or directly on the chassis 8 of the road paver 1. Together with the screw conveyors or a corresponding paving screed, the limiting plates form a so-called screw trough. This is intended to prevent mix from flowing forward from the screw space under the limiting plates in the direction of travel, where it cools down and the paving result deteriorates.

Corresponding limiting plates 6 require a minimum distance to the ground or subgrade to avoid collisions with it. In addition, with larger paving thicknesses, the distance between the screw and the limiting plates 6 and subgrade 9 can be increased by adjusting the screw and chassis height accordingly.

In FIG. 1, the corresponding limiting plates 6 are arranged adjacent to an upper side of subgrade 9 and, in the embodiment shown, are detachably attached to chassis 8.

Figure 2:
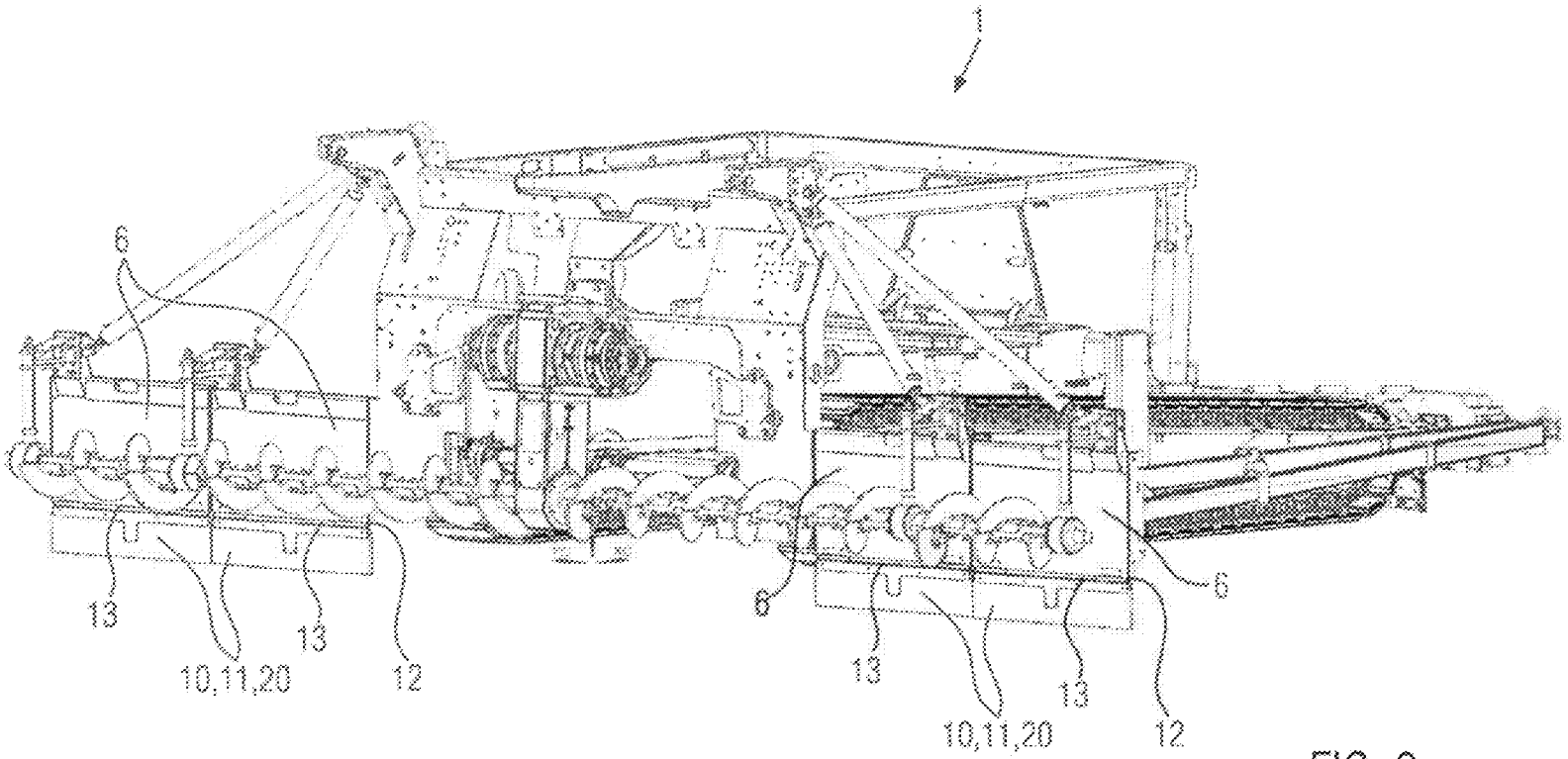
FIG. 2 shows a view analogous to FIG. 1 with flap extensions folded out or pushed out for each limiting plate.

If the distance to the subgrade is increased by raising the chassis 8, then limiting plate extensions 10, according to the disclosure, see FIG. 2, can be pivoted or shifted downwards in the direction of subgrade 9 in order to prevent the increased distance in the direction of travel corresponding to the flow of mix out of the screw space under the limiting plates. In FIG. 2, the corresponding limiting plate extensions 10 at the lower ends of the limiting plates 6 are extended to a corresponding fold-out position 20.

According to FIG. 2, the corresponding limiting plate extensions 10 are designed as flap extensions 11, which are pivotably mounted at the lower ends 12 of the limiting plates 6 by means of a corresponding pivot axis 13. The pivot axis 13 is arranged between the lower end 12 and an upper end of the flap extension 11 according to FIG. 2.

Figure 3:
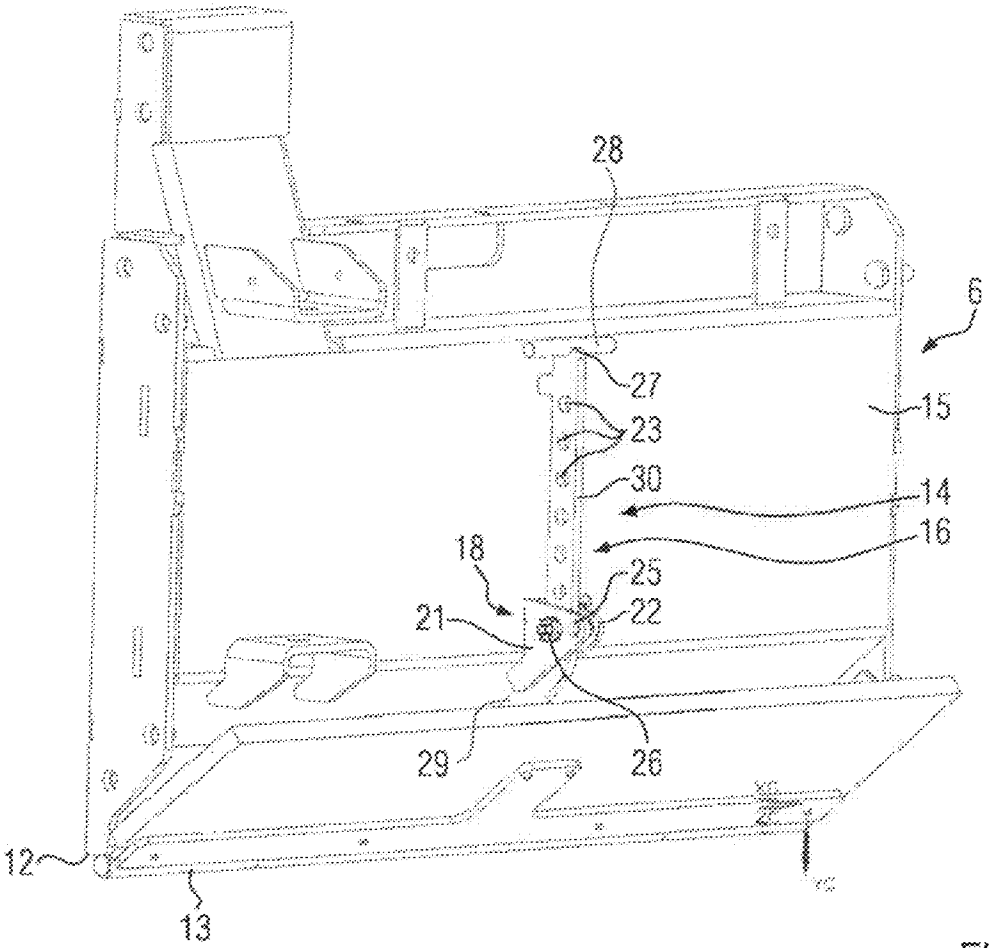
FIG. 3 shows a perspective rear view of a limiting plate (i.e., front view of the limiting plate with respect to a direction of travel of the road paver) according to a first embodiment with flap extension in fold-in position.
Figure 4:
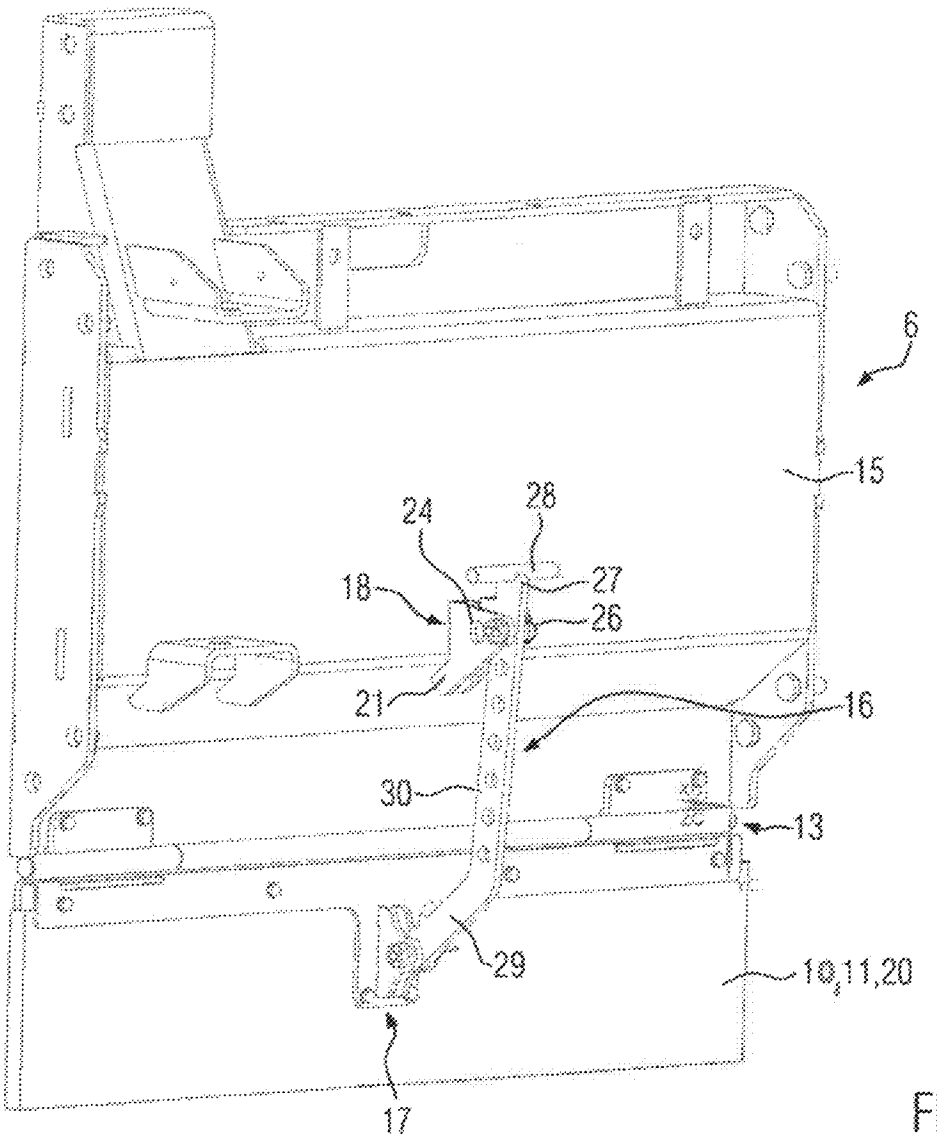
FIG. 4 shows a view analogous to FIG. 3 with flap extension in fold-out position.

FIGS. 3 and 4 show corresponding flap extensions 11 on limiting plate 6 in their different positions according to FIGS. 1 and 2, FIG. 3 in fold-in position 19 and FIG. 4 in fold-out position 20, which is also shown in FIG. 2.

FIG. 4 shows in particular the pivot axis 13 between the lower end 12 of the limiting plate 6 and the flap extension 11. A hinged flange 17 is arranged on a rear side of the flap extension 11 (i.e., front side of the flap extension 11 with respect to the direction of travel of the road paver 1), which is connected to an inclined hinged section 29 of a joint rod 16 running obliquely forwards and downwards in the direction of the hinged flange. The corresponding joint rod 16 is fixed to the hinged flange so that it can be pivoted. A substantially vertical positioning section 30 is connected to the correspondingly inclined hinged section 29 of the joint rod 16. This has a number of positioning openings 23, see FIGS. 3 and 4, which are used to fix the positioning section 30 to a retaining bracket 18 protruding from a rear side 15 of the limiting plate 6. This retaining bracket 18 has two spaced bracket parts 21 and 22, between which the positioning section 30 can be moved. Depending on the position of the positioning section 30 relative to the retaining bracket 18, the flap extension 11 is adjusted accordingly between, for example, fold-in position 19 according to FIG. 3 or fold-out position 20 according to FIG. 4. Corresponding intermediate positions are also possible, see the corresponding arrangement of the positioning openings 23.

In FIGS. 3 and 4, it should also be noted that the bracket parts 21 and 22 have at least two pairs of fixing openings 24 and 25 which are spaced apart perpendicularly to the rear side 15 of the limiting plate 6. In FIG. 3, a first pair of fixing openings 24, see also FIG. 4, is used to fix the positioning section 30 using appropriate fixing means 26, while in FIG. 4 a further pair of fixing openings 25, see also FIG. 3, is used for this fixation. The corresponding fixing means 26, for example, is an insertable bolt that can be fixed in its insertion position.

A handle 28 is attached to an upper end 27 of the joint rod 16, by means of which a user can adjust different relative positions between flap extension 11 and limiting plate 6 by raising or lowering the joint rod 16, see also the number of corresponding positioning openings 23 for such different relative positions.

In the case of flap extensions 11, it is also possible that these have a rubber wiper at the lower ends, i.e., at their free ends, which can avoid damage to the joint mechanism 14 in the event of a slight collision with the ground or subgrade.

It is also possible that a lower end section of the flap extension 11 is designed as such a rubber wiper.

FIGS. 5A-6B show another embodiment of a limiting plate extension 10 in the form of a slide extension 31. The slide extension 31, for example, comprises a sliding plate 32 and a bearing part 33. The bearing part 33 can be detachably fastened to the rear side of a limiting plate 6 (i.e., front side of the limiting plate 6 with respect to the direction of travel of the road paver 1), so that the sliding plate 32 can be moved relative to this bearing part 33 and thus to the limiting plate 6 into the corresponding positions according to FIGS. 5 and 6, see fold-in position 19 according to FIG. 5 and fold-out position 20 according to FIG. 6. In the fold-in position 19 the sliding plate 32 is so far away from the subgrade that it does not protrude downwards over the limiting plate 6, for example, see the corresponding arrangement of the limiting plates 6 according to FIG. 1 without protruding the limiting plate extension 10.

Figure 6B:
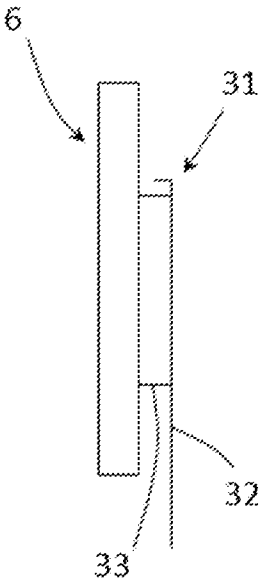
FIG. 6B is a schematic side view of the slide extension of FIG. 6A with the slide extension in the fold-out or extended position.
Figure 6A:
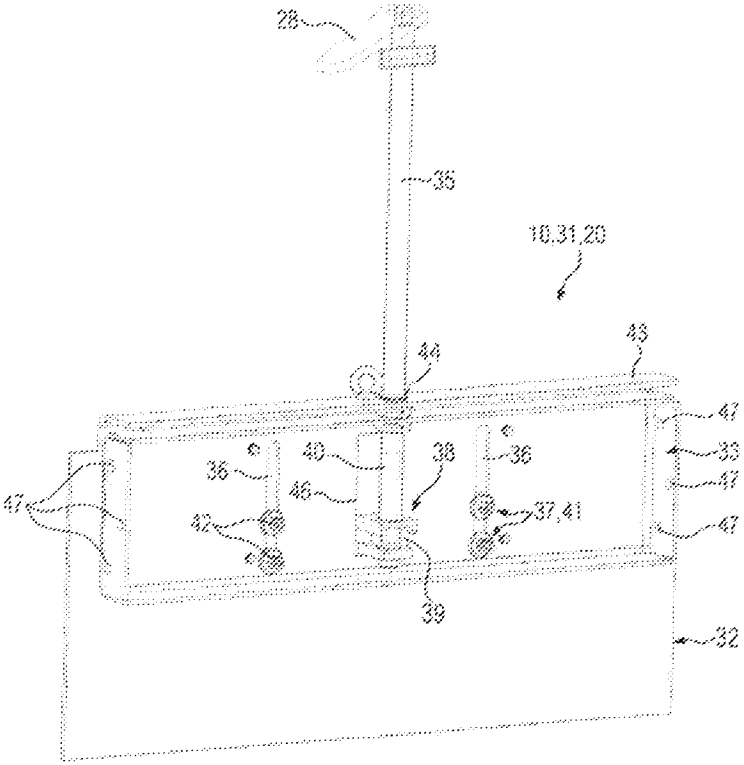
FIG. 6A shows a view as in FIG. 5A with the slide extension in a fold-out or extended position.

Accordingly, FIGS. 6A and 6B show an arrangement of the sliding plate 32 corresponding to the representation in FIG. 2, in which the limiting plate extension 10 protrudes downwards over the lower ends of the limiting plate 6.

Figure 5B:
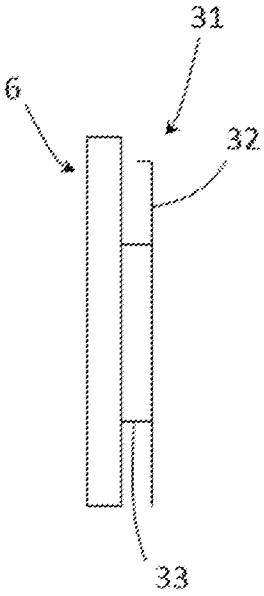
FIG. 5B is a schematic side view of the second embodiment of the slide extension shown in FIG. 5A fastened to a limiting plate.
Figure 5A:
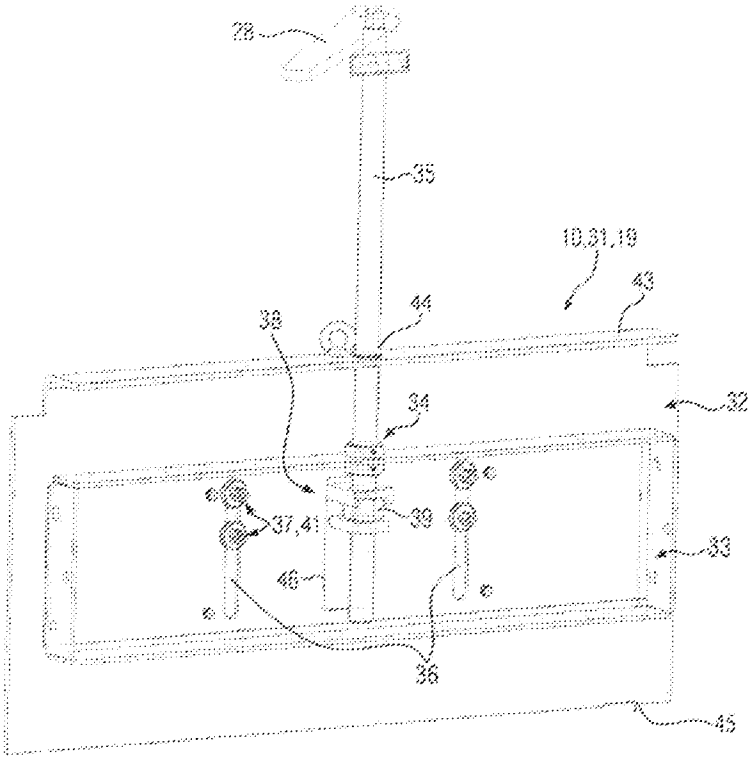
FIG. 5A shows a second embodiment of a flap extension in the form of a slide extension.

The bearing part 33 is essentially box-shaped and in FIGS. 5A and 6A open towards the observer. In an upper end there is a feed-through 34 for the sliding rod. Approximately in the middle, bearing part 33 has a longitudinal slot 46, through which an adjusting projection 38 is passed, which protrudes from a rear side of the sliding plate 32. The arrangement of the adjusting projection 38 relative to the longitudinal slot 46 determines the minimum or maximum extension position of the sliding plate 32 relative to the bearing part 33, whereby these correspond to the fold-in position 19, see FIGS. 5A and 5B, or the fold-out position 20, see FIGS. 6A and 6B. Guiding slots 36 are formed on both sides adjacent to the longitudinal slot 46, through which sliding projections 37 are passed in the form of sliding bolts 41, which also project from a corresponding rear side of the sliding plate 32. These sliding bolts 41 have screwed end section 42 to which corresponding nuts can be connected. These can also be used for fixing the relative positions between sliding plate 32 and bearing plate 33.

The actual adjustment of the sliding plate 32 relative to the bearing part 33 is carried out by turning a sliding rod 35. This sliding rod is guided longitudinally displaceably in a bore 44 of an upper cover edge 43 of the bearing part 33. The sliding rod 35 extends substantially vertically and is arranged with a lower external thread section 40 in a thread section 39, which is arranged or formed at the adjusting projection 38. The thread section 39, for example, can be designed as a nut fixed against rotation in the adjusting projection 38. By turning the sliding rod 35, the threaded section 39 is shifted along the external threaded section 40 and thus an adjustment of the adjusting projection 38, which is fastened to the sliding plate 32.

To facilitate the corresponding turning of the sliding rod 35, it has a handle 28 at its upper end.

The corresponding bearing part 33 can, for example, be detachably fastened to the rear side of a limiting plate 6 by means of lateral bores 47.

In the embodiment shown in FIGS. 5A-6B, a rubber wiper can also be arranged at a lower end 45 of the sliding plate 32 or a lower end section of the sliding plate can be designed as a rubber wiper.

Finally, it should be noted that the adjustment of the corresponding limiting plate extensions can also be carried out hydraulically or electrically in addition to manual. Corresponding adjustment mechanisms can be designed analogously to those already described so that, for example, the flap extension 11 can be pivoted or the sliding plate 32 raised and lowered hydraulically or electrically. With such a hydraulic or electric adjustment, this can also be done remotely and wirelessly. A corresponding adjustment is described in EP 17 206 966 for pivotal material deflectors. An actuator unit for movement, in particular for pivoting, is assigned to the material deflector, the actuator unit comprising an electric, hydraulic, electrohydraulic or pneumatic actuator.

What is claimed is:

1. A limiting plate assembly for a road finisher having a screw conveyor, the limiting plate assembly comprising:

a limiting plate configured to be detachably fastened on a traverse or on a chassis of the road finisher, and positioned in a travel direction of the road finisher in front of the screw conveyor, in order to increase a basic working width of the road finisher; and a limiting plate extension adjustably arranged on the limiting plate so as to be adjustable in a direction of a subgrade, and so that the limiting plate extension is positioned in front of the screw conveyor relative to the travel direction, when the limiting plate is fastened on the road finisher, to inhibit flow of material forward in the travel direction, wherein the limiting plate extension is pivotably mounted on the limiting plate and connected to a front side of the limiting plate via an adjustable joint mechanism, wherein the joint mechanism includes a joint rod that is adjustably connected to a retaining bracket on the front side of the limiting plate, wherein the joint rod has multiple positioning openings by means of which different relative positions of the joint rod and the retaining bracket are fixable, and wherein the joint rod has a substantially vertical, straight positioning section that includes the positioning openings and an inclined section that extends obliquely rearward and downward from the positioning section toward the limiting plate extension when the limiting plate is fastened on the road finisher.

2. The limiting plate assembly according to claim 1, wherein the limiting plate extension is movable between a fold-in position and a fold-out position relative to the limiting plate, and the positioning section is parallel to the front side of the limiting plate when the limiting plate extension is in the fold-in position.

3. The limiting plate assembly according to claim 1, wherein the limiting plate extension is formed as a flap extension.

4. The limiting plate assembly according to claim 3, wherein the flap extension is pivotably mounted substantially at a lower end of the limiting plate.

5. The limiting plate assembly according to claim 4, wherein a pivot axis connects the limiting plate and the flap extension.

6. The limiting plate assembly according to claim 1, wherein the inclined section of the joint rod comprises a straight section.

7. The limiting plate assembly according to claim 1, wherein the joint mechanism has a hinged flange projecting from the limiting plate extension, and the joint rod is pivotably mounted on the hinged flange.

8. The limiting plate assembly according to claim 7, wherein the retaining bracket has two spaced-apart bracket parts, between which the joint rod is arranged.

9. The limiting plate assembly according to claim 7, wherein the retaining bracket has at least two pairs of fixing openings which are spaced apart from one another and with which the positioning openings of the joint rod are alignable in different relative positions and in which a fixing means is engageable.

10. The limiting plate assembly according to claim 7, wherein the joint rod has at its upper end a handle.

11. The limiting plate assembly according to claim 1, wherein the limiting plate extension is electrically, hydraulically, electrohydraulically and/or pneumatically adjustable.

12. The limiting plate assembly according to claim 1, wherein the limiting plate extension is pivotable forwardly, with respect to the travel direction, to increase spacing between the limiting plate extension and the subgrade, and the limiting plate extension is pivotable rearwardly to decrease spacing between the limiting plate extension and the subgrade to inhibit paving mix from flowing forward under the limiting plate when the limiting plate is fastened on the road finisher.

13. The limiting plate assembly according to claim 1, further comprising a rubber wiper provided at a lower end of the limiting plate extension.

14. The limiting plate assembly according to claim 1, wherein a lower end section of the limiting plate extension is configured as a rubber wiper.

15. The limiting plate assembly according to claim 1, wherein the inclined section of the joint rod is pivotally connected to the limiting plate extension on a front side of the limiting plate extension.

16. A road paver comprising:

a screw conveyor;

a limiting plate mounted in front of the screw conveyor relative to a direction of travel of the road paver; and a limiting plate extension arranged on the limiting plate so as to be adjustable in a direction of a subgrade, and so that the limiting plate extension is positioned in front of the screw conveyor relative to the direction of travel of the road paver to inhibit flow of material forward in the travel direction, wherein the limiting plate extension is pivotably mounted on the limiting plate and connected to a front side of the limiting plate via an adjustable joint mechanism, wherein the joint mechanism includes a joint rod that is adjustably connected to a retaining bracket on the front side of the limiting plate, wherein the joint rod has multiple positioning openings by means of which different relative positions of the joint rod and the retaining bracket are fixable, and wherein the joint rod has a substantially vertical, straight positioning section that includes the positioning openings and an inclined section that extends obliquely rearward and downward from the positioning section toward the limiting plate extension.

17. The road paver of claim 16 wherein the limiting plate extension is formed as a flap extension.

18. The road paver according to claim 16, wherein the inclined section of the joint rod is pivotally connected to the limiting plate extension on a front side of the limiting plate extension.

19. The road paver according to claim 16, wherein the joint mechanism includes a hinged flange projecting from the limiting plate extension, and the inclined section of the joint rod is pivotably mounted on the hinged flange.

20. A limiting plate assembly for a road finisher having a screw conveyor, the limiting plate assembly comprising:

a limiting plate configured to be detachably fastened on the road finisher and positioned in a travel direction of the road finisher in front of the screw conveyor; and a limiting plate extension adjustably arranged on the limiting plate so as to be adjustable in a direction of a subgrade, and so that the limiting plate extension is positioned in front of the screw conveyor relative to the travel direction, when the limiting plate is fastened on the road finisher, to inhibit flow of material forward in the travel direction, wherein the limiting plate extension is pivotably mounted on the limiting plate and connected to a front side of the limiting plate via an adjustable joint mechanism, the joint mechanism includes a joint rod having a substantially vertical positioning section that is adjustable with respect to the limiting plate to adjust the position of the limiting plate extension relative to the limiting plate, and the joint rod further has an inclined, straight section that extends obliquely rearward and downward from the positioning section toward the limiting plate extension when the limiting plate is fastened on the road finisher.

21. The limiting plate assembly according to claim 20, wherein the limiting plate extension is electrically, hydraulically, electrohydraulically and/or pneumatically adjustable relative to the limiting plate.

22. The limiting plate assembly according to claim 20, wherein the inclined section of the joint rod is pivotally connected to the limiting plate extension on a front side of the limiting plate extension.

23. The limiting plate assembly according to claim 20, wherein the positioning section of the joint rod has multiple positioning openings by means of which different relative positions of the joint rod and the limiting plate are fixable.

24. The limiting plate assembly according to claim 20, wherein the limiting plate extension is pivotable between a fold-out position and a fold-in position, and wherein the limiting plate extension is positioned rearward of the front side of the limiting plate when the limiting plate extension is in the fold-out position and the limiting plate is fastened on the road finisher.

25. The limiting plate assembly according to claim 24, wherein the limiting plate extension is pivotably adjustable to multiple intermediate positions between the fold-out position and the fold-in position.

26. A road finisher comprising:

a screw conveyor; and the limiting plate assembly according to claim 20.

27. The limiting plate assembly according to claim 20, wherein the limiting plate extension is pivotable about a pivot axis between a fold-in position and a fold-out position relative to the limiting plate, and the positioning section is positioned entirely above the pivot axis when the limiting plate extension is in the fold-in position, and the positioning section extends below the pivot axis when the limiting plate extension is in the fold-out position.

28. The limiting plate assembly according to claim 27, wherein an end of the limiting plate extension extends above the pivot axis when the limiting plate extension is in the fold-in position.

* * * * *